United States Patent [19]

Juergens

[11] 4,258,852

[45] Mar. 31, 1981

[54] AUXILIARY COUNTERWEIGHT ARRANGEMENT FOR MOBILE CRANE

[75] Inventor: Dieter C. Juergens, Bark River, Mich.

[73] Assignee: Harnischfeger Corporation, West Milwaukee, Wis.

[21] Appl. No.: 42,366

[22] Filed: May 25, 1979

[51] Int. Cl.[3] ..... B66C 23/72

[52] U.S. Cl. ..... 212/178; 212/197

[58] Field of Search ..... 212/49, 58 R, 145, 8 R, 212/48, 57, 46 A, 144

[56] References Cited

U.S. PATENT DOCUMENTS

| | | | |
|---|---|---|---|
| 3,842,984 | 10/1974 | Brown et al. | 212/58 R |
| 3,930,583 | 1/1976 | Jouffray | 212/49 |

FOREIGN PATENT DOCUMENTS

| | | | |
|---|---|---|---|
| 1258054 | 1/1968 | Fed. Rep. of Germany | 212/145 |

*Primary Examiner*—James B. Marbert

*Attorney, Agent, or Firm*—James E. Nilles

[57] ABSTRACT

An auxiliary counterweight arrangement resists lateral as well as forward tipping of a mobile crane that has a platform rotatable about a vertical axis and a boom mounted on the platform to swing in a vertical plane containing said axis. The boom normally projects at a forward and upward inclination from the platform, and its top, from which a load line depends, may be connected with the top of a mast that is behind it, in the same vertical plane. Two surface-supported counterweight carriers are rigidly attached to the platform, spaced equal distances to the rear of it and at equal distances to opposite sides of said vertical plane. Each carries a counterweight. With a mast on the platform, a guy line extends from its top to each counterweight; otherwise, a guy line extends from the top of the boom to each counterweight. Lengthening the arms of the V-shaped rigid connection between platform and counterweight carriers increases resistance to lateral tilting in step with increased resistance to forward tilting.

11 Claims, 4 Drawing Figures

AUXILIARY COUNTERWEIGHT ARRANGEMENT FOR MOBILE CRANE

FIELD OF THE INVENTION

This invention relates to mobile hoisting cranes and is more specifically concerned with apparatus in the nature of an accessory by which the lifting capacity of a mobile crane can be greatly increased, thus increasing the versatility of such a crane.

BACKGROUND OF THE PRIOR ART

There has long been a recognized need for a mobile crane capable of lifting exceptionally heavy weights, as pointed out in U.S. Pat. No. 3,202,299, issued in 1965. A number of proposals have been advanced for satisfying this need, and most such proposals have involved the provision of a counterweight or auxiliary counterweight arranged to resist the forward tilting forces imposed upon the crane boom as a heavy load is picked up. In addition to the patent just mentioned, see for example U.S. Pat. No. 3,842,984, which discloses a trailer-like counterweight carrier that is pivotally connected to the boom carrying platform of a crane so that the counterweight carrier can have limited movement in a vertical plane. The last cited patent discusses other prior art that discloses counterweight and auxiliary counterweight trailers.

The several proposals in the prior art for counterweight arrangements are concerned with various aspects of the generally obvious problem of compensating for the forward tilting force that is imposed upon a crane boom when an exceptionally heavy load is imposed upon it. What has apparently not been appreciated heretofore is that high lateral tilting forces are also imposed upon the boom as the platform that carries it begins to rotate about its vertical axis and as it decelerates from such rotation. To afford optimum mobility, a mobile crane has the smallest base that will afford it adequate stability when it is lifting loads for which it is basically designed; hence there is no assurance that it will have adequate lateral stability when lifting the exceptional loads for which auxiliary counterbalancing is employed. It must be borne in mind that substantial and unexpected wind force loads can be added to the lateral forces imposed by a swinging load to increase the danger of lateral tilting.

The present invention is based upon a recognition of a relationship that has apparently not been appreciated heretofore, namely, that any substantial increase in forward tilting force upon the boom of a mobile crane, such as occasions the need for auxiliary counterweighting, is accompanied by a more or less corresponding increase in lateral tilting forces for which suitable compensation should also be made.

Thus it is the general object of the present invention to provide means for increasing the lateral stability of a mobile crane in substantially direct relationship to an increase in its lifting capacity that is obtained by equipping it with auxiliary counterweight means.

In the attainment of this objective, the maneuverability of the crane should not be compromised, and desirably no more than a minimum of auxiliary equipment—preferably none—should have to be installed on the crane in order to provide the increased lateral stability. In relation to these desiderata, it should be borne in mind that the augmented lateral tipping stability, to be useful, must be available in every position of rotation of the platform that carries the boom.

In view of these considerations, it is a more specific object of the invention to provide counterbalancing apparatus for resisting tilting forces on a mobile crane, adapted to be installed on the crane when an extraordinarily large load is to be hoisted with it, and whereby the crane is given increased resistance to lateral tilting forces in substantially direct ratio to increase in resistance to forward tilting forces.

Another specific object of the invention is to provide means in the nature of an accessory for a mobile crane, capable of being installed on it when it is to hoist an extraordinarily large load and whereby the crane is enabled to resist the tilting forces which the load imposes upon the crane in lateral as well as forward directions, and operative in all positions of rotation of the platform upon which the crane boom is mounted.

SUMMARY OF THE INVENTION

In general, the objects of the invention are achieved in a crane of the type comprising a platform mounted on support means for rotation about a vertical axis, rigid upwardly projecting load supporting means on said platform comprising a boom, a load supporting line extending from the top of said boom and normally in a vertical plane that also substantially contains said boom and said axis, mobile counterweight carrier means spaced from said platform and connected therewith, and counterweight means supported by said carrier means and having a connection with the top of said load supporting means for resisting tilting forces imposed upon the boom by a load carried by said line, said crane being characterized by: said mobile counterweight carrier means comprising a pair of mobile counterweight carriers; rigid means connecting each of said counterweight carriers with the platform and maintaining said counterweight carriers in spaced relation to one another and to the platform, with the counterweight carriers at equal distances to opposite sides of said vertical plane and at substantially equal distances from said platform; and said counterweight means comprising a counterweight carried by each of said counterweight carriers, each of said counterweights having a connection with the top portion of said load supporting means whereby tilting forces in directions transverse to said vertical plane are resisted.

BRIEF DESCRIPTION OF DRAWINGS

In the accompanying drawings, which illustrate what is now regarded as a preferred mode of embodying the principles of the invention.

DETAILED DESCRIPTION OF THE INVENTION

Figure 1:
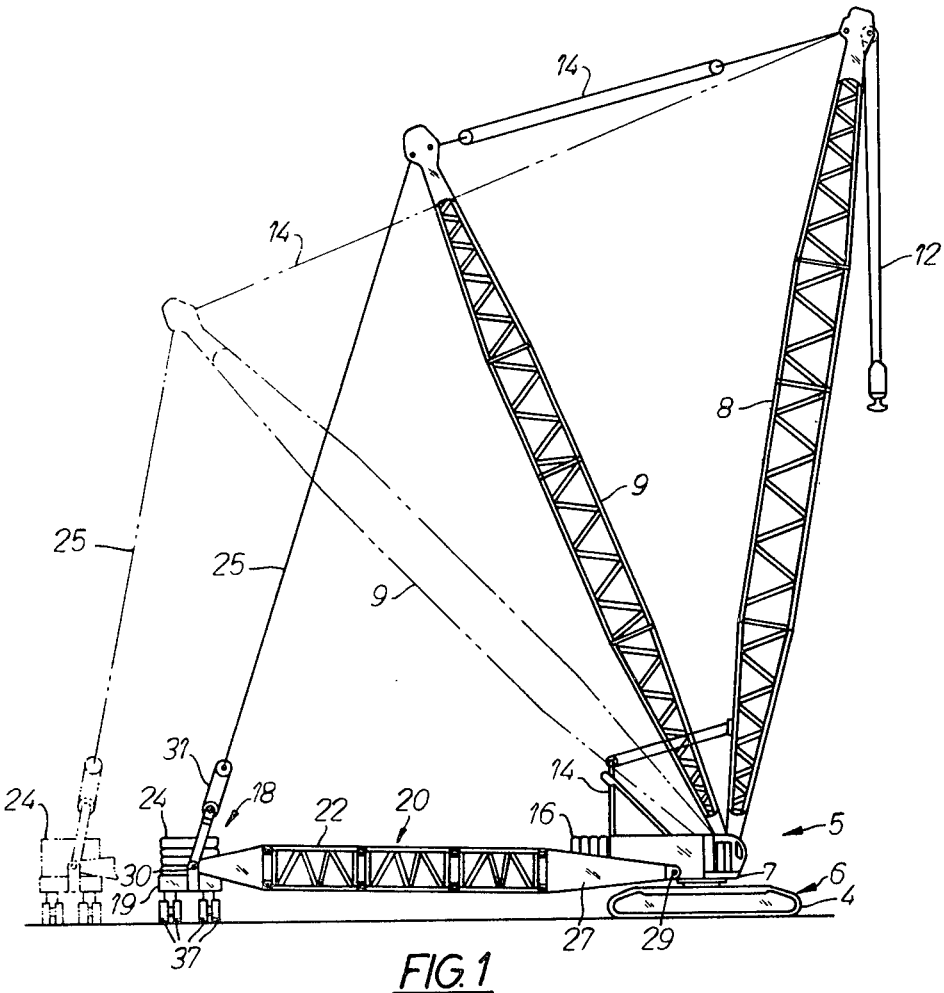
FIG. 1 is a side view of a mobile crane which has been adapted for the hoisting of extraordinarily heavy loads by the installation of counterbalancing means of this invention.
Figure 2:
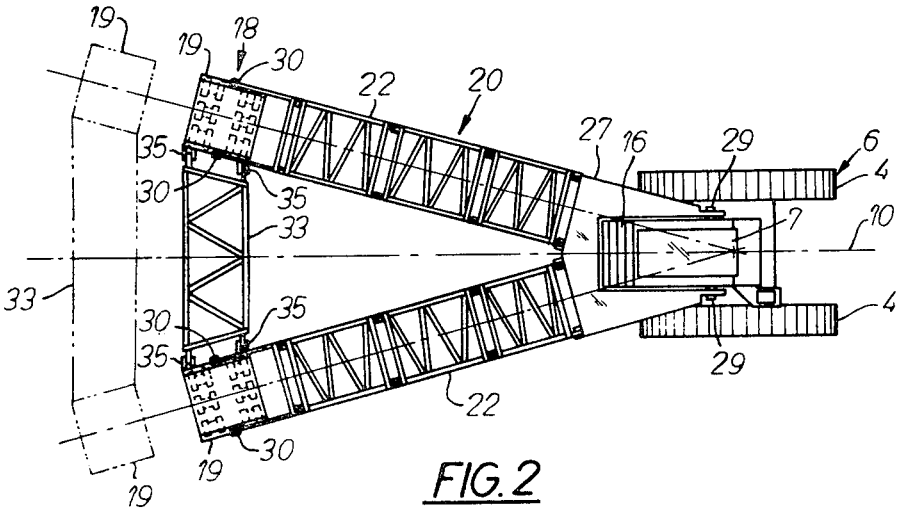
FIG. 2 is a plan view of the crane shown in FIG. 1, with its boom and mast omitted for simplicity.

Referring now to the accompanying drawings, the numeral 5 designates generally a more or less conventional mobile crane having an earthborne crane base 6 which is illustrated as an assembly comprising endless crawler treads 4. Mounted on the base 6 for rotation relative to it about a vertical axis is a horizontal platform 7 which in turn supports a boom 8 and a mast 9. It will be understood that either the boom 8, the mast 9, or both of them, could be lengthwise extendable by means of inserted sections, in accordance with generally conventional practice.

The boom 8 swings in a vertical plane 10 that contains, or is close to, the vertical axis around which the platform 7 rotates, and the horizontal axis about which the boom swings is near the level of the platform and close to the vertical axis just mentioned. Through the range of its normal swinging motion the boom 8 projects upwardly from the platform 7 and away from said vertical axis in a direction that can be regarded as forward.

As is conventional, a load line 12 that passes over the upper end of the boom and normally depends therefrom is connected with a power driven winch (not shown) that is mounted on the platform 7. The load line 12 normally lies in the vertical plane 10 that substantially contains the boom 8 and the vertical axis about which the platform 7 swings. It will be apparent that the mast 8 and the boom 9 together comprise means for supporting a load on the load line 12.

The mast 9 has its lower end mounted to the platform 7 directly behind the connection between the boom 8 and the platform, and it swings in the same vertical plane 10 as the boom but normally projects up from the platform at a more or less rearwardly oblique angle. An adjustable guy line 14 is connected between the upper end of the mast 9 and the upper end of the boom 8.

Mounted on the platform 7 is a conventional counterweight 16 which is spaced some distance to the rear of the vertical axis of platform rotation. When the crane is used in its conventional configuration, the counterweight 16 offsets the tilting forces imposed upon it by the boom 8 and any hoisted load supported by the boom.

The counterweight arrangement of this invention, generally designated by 18, serves to counterbalance larger tilting forces imposed upon the crane by very heavy hoisting loads. The novel counterweight arrangement 18 comprises a pair of trailer-like counterweight carriers 19 and connecting means 20 by which the counterweight carriers are connected to the rear of the platform 7 and are maintained in rearwardly spaced relation to the platform and in laterally spaced relation to one another.

The connecting means 20 comprises a pair of arms 22 which are so arranged that their longitudinal centerlines define a V that diverges rearwardly and has its apex at the vertical axis about which the platform 7 swings. The counterweight carriers 19 are connected to the rear ends of the respective arms 22 and are thus established by the connecting means 20 in relative positions equidistant from the platform 7 and laterally spaced from one another. Note that the connecting means 20 is arranged symmetrically with respect to the vertical plane 10 so that the counterweight carriers 19 are spaced equal distances to opposite sides of that vertical plane.

Figure 3:
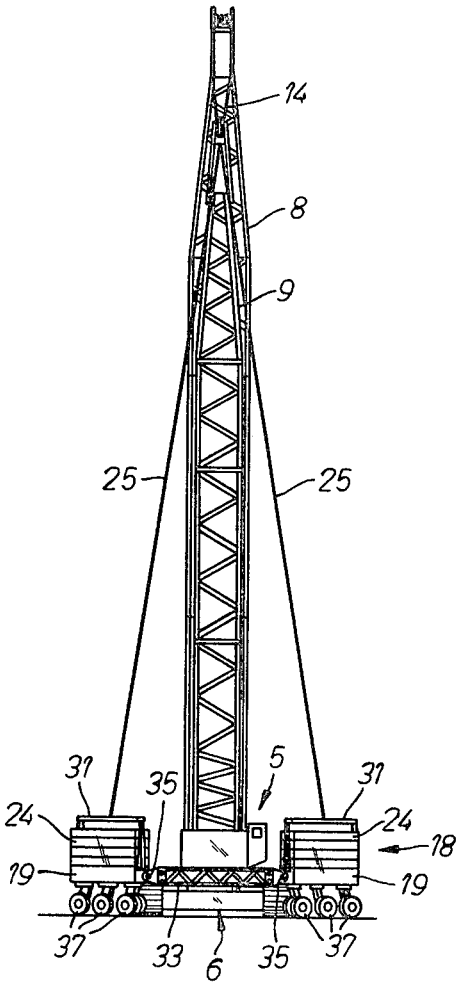
FIG. 3 is a view of the crane in rear elevation.

Each of the counterweight carriers 19 supports a substantially heavy counterweight 24, and a guy line 25 extends down from the top of the mast 9 to each of the counterweights. The counterweights 24 of course offset forward tilting forces imposed upon the boom 8 by an extraordinary load, and in that respect their function is substantially conventional, as is apparent from FIG. 1. However, because of the laterally spaced apart relationship between the counterweight carriers 19, the counterweights 24 additionally serve to afford a substantial amount of stability against lateral tilting, as can be seen from FIG. 3. In offsetting both fore-and-aft and lateral tilting forces that are imposed upon the platform 7, the counterweights 24 help to ensure that the load supported by the crawler treads 4 will be distributed substantially uniformly over both of them.

The arms 22 are connected with the platform 7 by means of a sturdy yoke-like front member 27 which is rigidly secured to the arms 22 and pivotably connected to the platform 7 by means of hinge-like connections 29. The yoke-like member 27, and with it the arms 22, are swingable up and down about a horizontal axis that is normal to the vertical plane 10 and is spaced close to the vertical axis of rotation of the platform 7.

Each of the arms 22 is of sturdy truss construction having substantial depth and substantial width. Preferably those arms consist of lengthwise connectable modular units so that they can be lengthened or shortened by adding or removing modules, to increase or decrease the moment arm of the counterweight carriers 19 in accordance with the load to be hoisted. Because of the divergence of the arms 22, the lateral distance between the counterweight carriers 19 increases in step with the distance between the counterweight carriers and the platform 7, which is to say that the lateral moment arm of the carriers 19 increases in correspondence with increase in their longitudinal moment arm.

Each of the arms 22 has a bifurcated rear end that is connected to one of the counterweight carriers 19 by means of coaxial pivots or trunnions 30 at opposite ends of the counterweight carrier. The horizontal axis of the trunnions 30 lies in the longitudinal plane of symmetry of the counterweight carrier, at or near the level of the center of gravity of the carrier and its counterweight, and extends transversely to the length of the arm 22 that is connected to the counterweight carrier. The guy line 25 that extends down from the mast 9 to each counterweight carrier is connected to a bail 31 which can be vertically adjustable and which is pivoted to the carrier. The bail 30 can be connected to the trunnions 30 to swing about the axis defined by those trunnions.

To maintain the counterweight carriers 19 in laterally spaced relation to one another, there is connected between them a rigid strut 33 that has its length transverse to the vertical plane 10. The strut 33 is preferably of truss construction and comprises modules which are properly related in length to the modules that comprise the arms 22, so that the length of the strut 33 can be suitable for the lengths of the arms 22. Each of the counterweight carriers 19 has a pivotal connection 35 to its end of the strut whereby the strut and the counterweight carrier are swingable relative to one another about an axis parallel to the longitudinal centerline of the arm 22 that is connected to the counterweight carrier.

It will be seen that the pivotal connections 29, 30 and 35 maintain the platform 7 and the counterweight carriers 19 in substantially fixed relationship to one another horizontally but accommodate small vertical displacements of each counterweight carrier relative to the other one and to the platform 7, such as would arise in consequence of small irregularities in the surface upon which the counterweight carriers ride. It will also be apparent that the sturdiness and rigidity of the arms 22 and strut 33 enables those elements of the connecting means 20 to withstand the horizontal forces exerted during rotation of the platform 7 about its vertical axis and concommitant circumferential motion of the counterweight carriers 19, and also enables the arms 22 to sustain the substantial endwise compression loads imposed upon them as a result of opposing forces exerted by the boom 8 and the counterweights 24 during hoisting.

The counterweight carriers 19 are trailer-like units of a known type, each having a large number of wheels 37 that are castered or are hydraulically or electrically steerable so that they can be caused to track concentrically to the vertical axis about which the platform 7 pivots, and of course they will always be arranged for such tracking whenever the platform is being swung. However, if the wheels 37 are power steerable, they can be adjusted to align with the crawler treads 4 of the base 6 so that the crane proper and the counterweight carriers 19 can effectively move as a unit for travel to and from a hoisting position and for short-distance transport of a hoisted load. Preferably at least certain of the wheels 37 are power-driven for rotation, so that the counterweight carriers can serve to actuate the platform 7 in swinging about its vertical axis.

Since vertical displacements of the counterweight carriers 19 are transmitted to the top of the mast 9 and the boom 8 through the guy lines 25, the surface traversed by the counterweight carriers should be reasonably flat and level. Obviously the counterweight carriers, instead of being mounted on rubber-tired wheels, as illustrated, could be mounted on flanged wheels riding on a circular or arcuate track, or on endless crawler treads.

Figure 4:
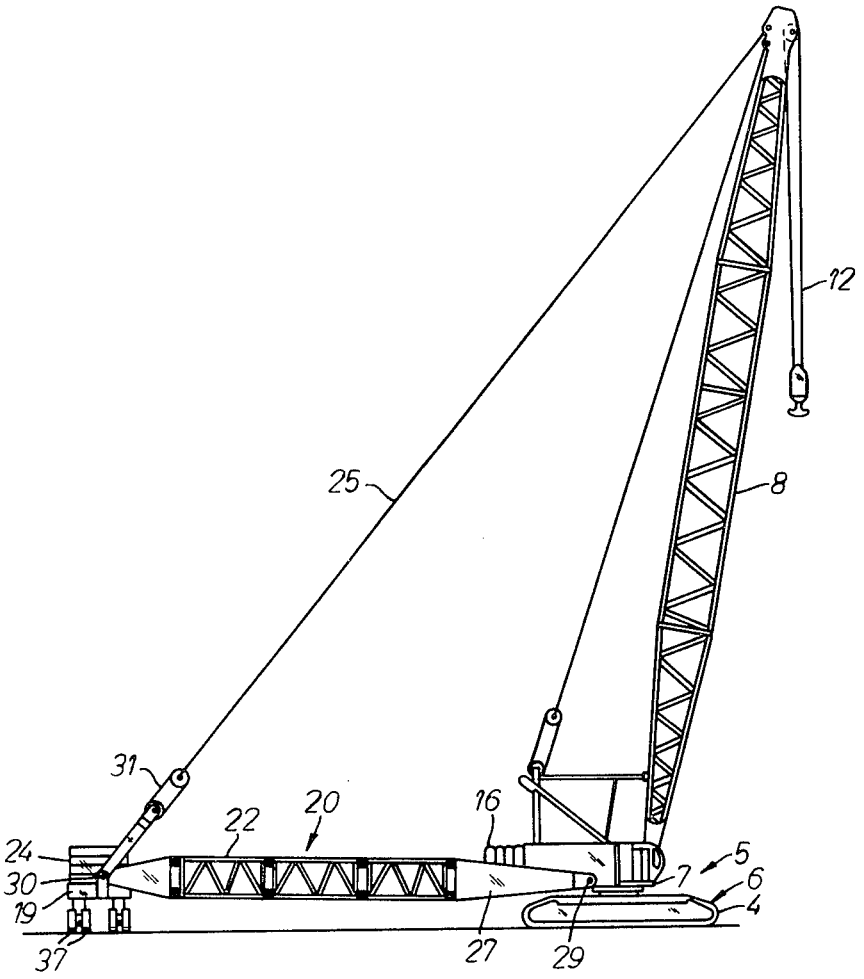
FIG. 4 is a side view of a mobile crane having counterbalancing means of this invention and having no mast.

In the embodiment of the invention illustrated in FIG. 4 the crane has no mast and, instead, the guy lines 25 that extend to the counterweights 24 have their upper ends connected to the top of the boom 8. With this arrangement an extremely heavy load can be lifted by a crane that has no mast, with good stability against lateral tilting as well as against tilting forward. However, the boom 8 will normally be maintained in a more nearly vertical position with this arrangement than if a mast were present, to prevent the imposition of excessively high tension loads on the guy lines 25, such as would develop if the boom were swung forwardly a substantial distance from the position in which it is shown.

From the foregoing description taken with the accompanying drawings it will be apparent that this invention provides means for adapting a mobile crane for hoisting extraordinarily large loads, whereby the crane is effectively stabilized against lateral tilting as well as against tilting forward under the load force.

I claim:

1. A crane of the type comprising a platform mounted on support means for rotation about a vertical axis, rigid upwardly projecting load supporting means on said platform comprising a boom, a load supporting line extending from the top of said boom and normally in a vertical plane that also substantially contains said boom and said axis, mobile counterweight carrier means spaced from said platform and connected therewith, and counterweight means supported by said carrier means and having a connection with the top of said load supporting means for resisting tilting forces imposed upon the boom by a load carrier by said line, said crane being characterized by:

A. said mobile counterweight carrier means comprising a pair of mobile counterweight carriers;

B. rigid means connecting each of said counterweight carriers with the platform and maintaining said counterweight carriers in spaced relation to one another and to the platform, with the counterweight carriers at equal distances to opposite sides of said vertical plane and at substantially equal distances from the platform; and C. said counterweight means comprising a counterweight carried by each of said counterweight carriers, each of said counterweights having a guying connection with the top portion of said load supporting means whereby tilting forces in directions transverse to said vertical plane are resisted.

2. The crane of claim 1, further characterized by:

said rigid means comprising a pair of arms, one for each counterweight carrier, which are connected with said platform and diverge rearwardly.

3. The crane of claim 1, further characterized by said rigid means comprising:

(1) a pair of arms, one for each counterweight carrier, which are connected with the platform and diverge rearwardly therefrom, and (2) a strut connected between said counterweight carriers and extending transversely to said plane.

4. The crane of claim 3, further characterized by:

(1) said arms being connected with said platform to swing relative thereto about an axis which extends transversely to said vertical plane;

(2) each of said arms having a bifurcated rear end portion which straddles a counterweight carrier and has pivotal connections therewith, at opposite sides thereof, that are concentric to a horizontal axis extending transversely to the arm; and (3) said strut having a pivotal connection with each of said counterweight carriers, each of the last mentioned pivotal connections having an axis substantially parallel to the length of the arm connected to the counterweight carrier.

5. The crane of claim 1, further characterized by:

said arms and said strut comprising endwise detachably connectable modular sections so that by installation and removal of such sections the counterweight carriers can be positioned at any of a number of different distances from the platform and from one another, in accordance with loads to be lifted.

6. Accessory means for enabling the lifting of extraordinarily heavy loads with a mobile crane that comprises a platform mounted on a surface-supported mobile base for rotation about a vertical axis, a boom mounted on said platform for swinging in a vertical plane that substantially contains said axis, a load supporting line depending from the top of said boom, and a mast mounted on said platform and projecting upwardly therefrom substantially in said plane, said mast having near its top a connection with an upper portion of said boom, said accessory means comprising:

A. a pair of surface-supported mobile counterweight carriers;

B. means for providing a detachable but rigid connection between said platform and each of said counterweight carriers whereby the counterweight carriers are established (1) at equal distances rearwardly from said platform and (2) at equal distances to opposite sides of said vertical plane;

C. a counterweight carried by each of said counterweight carriers; and

D. a guying connection between each of said counterweights and the top portion of the mast whereby tilting forces in directions transverse to said vertical plane as well as forwardly in that plane are resisted.

7. A crane of the type comprising a platform mounted on support means for rotation about a vertical axis, rigid upwardly projecting load supporting means on said platform comprising a boom, a load supporting line extending from the top of said boom and normally in a vertical plane that also substantially contains said boom and said vertical axis, mobile counterweight carrier means spaced from said platform and connected therewith, and counterweight means supported by said carrier means and having a connection with the top of said load supporting means for resisting tilting forces imposed upon the boom by a load carried by said line, said crane being characterized by:

A. said mobile counterweight carrier means comprising a pair of mobile counterweight carriers;

B. the connection between said platform and said counterweight carriers comprising substantially rigid V-shaped structure having a pair of elongated divergent arms;

C. said V-shaped structure being connected with said platform (1) for swinging motion relative to the platform about a horizontal axis which is normal to said vertical plane and near said vertical axis and (2) with said arms diverging in a rearward direction relative to said platform and disposed substantially symmetrically in relation to said vertical plane;

D. each of said counterweight carriers being connected with one of said arms, at the rear end of the latter, for pivoting relative to the arm about a horizontal axis transverse to the length of the arm;

E. said counterweight carriers being maintained in spaced relation to one another, at equal distances to opposite sides of said vertical plane, by a rigid strut extending transversely to said vertical plane; and F. said counterweight means comprising a counterweight carried by each of said counterweight carriers, each of said counterweights having a connection with the top portion of said load supporting means whereby tilting forces in directions transverse to said vertical plane are resisted.

8. The crane of claim 7, further characterized by:

G. said strut having a pivotal connection with each of said counterweight carriers, each of the last mentioned pivotal connections having an axis substantially parallel to the length of the arm connected to the counterweight carrier.

9. The crane of claim 7, further characterized by:

each of said arms having a bifurcated rear end portion which straddles a counterweight carrier and has coaxial trunnion connections therewith, at opposite sides of the counterweight carrier.

10. The crane of claim 7 wherein the longitudinal centerlines of the arms of said V-shaped structure intersect substantially at said vertical axis.

11. A crane of the type comprising a platform mounted on support means for rotation about a vertical axis, rigid upwardly projecting load supporting means on said platform comprising a boom, a load supporting line extending from the top of said boom and normally in a vertical plane that also substantially contains said boom and said vertical axis, mobile counterweight carrier means spaced from said platform and connected therewith, and counterweight means supported by said carrier means and having a connection with the top of said load supporting means for resisting tilting forces imposed upon the boom by a load carried by said line, said crane being characterized by:

A. said mobile counterweight carrier means comprising a pair of mobile counterweight carriers;

B. the connection between said platform and said counterweight carriers comprising substantially rigid V-shaped structure having a pair of arms, one for each counterweight carrier, said arms (1) diverging in a rearward direction relative to said platform and each having its counterweight carrier connected to it at its rear end, (2) being disposed substantially symmetrically relative to said vertical plane, and (3) each comprising endwise detachably connectable modular sections which can be installed and removed to position the counterweight carriers at any of a plurality of different distances from the platform and from one another in accordance with loads to be lifted;

C. a strut connected between the counterweight carriers and extending transversely to said plane to maintain the counterweight carriers spaced apart at equal distances to opposite sides of said vertical plane; and D. a counterweight carried by each of said counterweight carriers, each of said counterweights having a connection with the top portion of the load supporting means whereby tilting forces in directions transverse to said vertical plane are resisted.

* * * * *